US010441831B2

(12) United States Patent
Lackore, Jr. et al.

(10) Patent No.: US 10,441,831 B2
(45) Date of Patent: Oct. 15, 2019

(54) ERGONOMIC HOSE LOAD PLATFORM

(71) Applicants: James Roger Lackore, Jr., Big Bend, WI (US); Scott D. Williamson, Dodge, NE (US)

(72) Inventors: James Roger Lackore, Jr., Big Bend, WI (US); Scott D. Williamson, Dodge, NE (US)

(73) Assignee: Spartan Motors, Inc., Charlotte, MI (US)

( * ) Notice: Subject to any disclaimer, the term of this patent is extended or adjusted under 35 U.S.C. 154(b) by 0 days.

(21) Appl. No.: 15/616,497

(22) Filed: Jun. 7, 2017

(65) Prior Publication Data

US 2018/0353785 A1 Dec. 13, 2018
US 2019/0201726 A9 Jul. 4, 2019

(51) Int. Cl.

| | |
|---|---|
| ***A62C 33/04*** | (2006.01) |
| ***A62C 27/00*** | (2006.01) |
| ***B65H 75/36*** | (2006.01) |
| ***B65H 75/44*** | (2006.01) |
| ***B65H 75/42*** | (2006.01) |

(52) U.S. Cl.

CPC ..... *A62C 33/04* (2013.01); *A62C 27/00* (2013.01); *B65H 75/362* (2013.01); *B65H 75/425* (2013.01); *B65H 75/4402* (2013.01); *B65H 2701/33* (2013.01); *Y10T 137/6899* (2015.04)

(58) Field of Classification Search

CPC ..... A62C 27/00; A62C 29/00; A62C 31/00; A62C 31/28; A62C 33/00; A62C 33/04; A62C 33/06; B65H 75/40; B65H 75/42; B65H 75/425; B65H 75/4402; B65H 75/36; B65H 75/362; Y10T 137/6899

USPC ..... 137/899, 351, 355.16–355.28; 296/57.1, 296/62

See application file for complete search history.

(56) References Cited

U.S. PATENT DOCUMENTS 1,883,473 A * 10/1932 Barrett ..... B62D 33/0273 296/51
3,319,905 A * 5/1967 Kissilov ..... B65H 75/425 242/390.8
3,368,773 A * 2/1968 Linderman ..... A01G 25/095 242/390.5
3,396,747 A * 8/1968 Moore ..... B63C 11/52 137/355.21
3,774,630 A * 11/1973 Prange ..... B65H 75/4402 137/355.12
4,191,348 A * 3/1980 Holwerda ..... B64F 5/20 126/271.1
4,853,500 A * 8/1989 Tydlacka ..... B65H 75/362 191/12 R
4,944,258 A * 7/1990 Knutson ..... B08B 9/0433 134/167 C
5,042,515 A * 8/1991 Boczkiewicz ..... B65H 75/44 134/167 C
5,246,181 A * 9/1993 Straub ..... B60P 3/035 242/399.2

(Continued)

*Primary Examiner* — Robert K Arundale
*Assistant Examiner* — Jonathan J Waddy
(74) *Attorney, Agent, or Firm* — Reinhart Boerner Van Deuren P.C.

(57) ABSTRACT

An ergonomic hose load platform for a fire fighting vehicle is provided. The ergonomic hose load platform includes a platform and at least one pivot mount defining a pivot axis. The platform is pivotable about the pivot axis to open and close the platform.

11 Claims, 7 Drawing Sheets

(56) References Cited

U.S. PATENT DOCUMENTS

| | | | | | |
|---|---|---|---|---|---|
| 5,518,287 | A * | 5/1996 | Totani | B60P 1/26 | 296/50 |
| 5,785,372 | A * | 7/1998 | Glatzmeier | B62D 33/042 | 296/24.45 |
| 6,006,841 | A * | 12/1999 | Hunke | A62C 27/00 | 137/355.2 |
| 6,027,320 | A * | 2/2000 | Hendrix | F04B 41/00 | 137/355.26 |
| 6,089,639 | A * | 7/2000 | Wojnowski | B60P 3/14 | 296/37.6 |
| 6,773,047 | B2 * | 8/2004 | Gruber | B62D 33/0273 | 296/57.1 |
| 6,973,975 | B1 * | 12/2005 | Adamson | A62C 5/02 | 169/24 |
| 7,834,750 | B1 * | 11/2010 | Hertz | B60Q 1/2692 | 340/468 |
| 8,215,422 | B2 * | 7/2012 | Abel | B60P 1/14 | 180/22 |
| 8,764,090 | B2 * | 7/2014 | Kerr | E05F 15/627 | 296/146.4 |
| 9,884,576 | B1 * | 2/2018 | McLoughlin | B60P 1/549 | |
| 2007/0252402 | A1 * | 11/2007 | Marshall | B62D 33/0273 | 296/57.1 |
| 2008/0271901 | A1 * | 11/2008 | Decker | A62C 27/00 | 169/46 |
| 2014/0291371 | A1 * | 10/2014 | Halley | A62C 27/00 | 224/522 |
| 2017/0248252 | A1 * | 8/2017 | Roodenburg | F16L 1/203 | |
| 2017/0355551 | A1 * | 12/2017 | Turner | B65H 75/425 | |

* cited by examiner

ERGONOMIC HOSE LOAD PLATFORM

FIELD OF THE INVENTION

This invention generally relates to fire hose beds on fire fighting vehicles.

BACKGROUND OF THE INVENTION

Firefighters are not satisfied with the time and effort it takes to load a fire hose into a fire fighting vehicle after fire suppression activities are completed. Delay in loading apparatus and fire hose onto or in a firefighting vehicle for the next incident may result in structural damage to property and even in some cases to loss of life. Fire fighting vehicles such as pumper trucks may be dedicated to any one of or combinations of critical functions such as carrying water, pumping water, carrying ladders and carrying a fire hose.

For example, pumper trucks carry their own supply of water for fighting fires. The water is pumped from the truck through the fire hoses they carry and then to the fire until a dedicated water supply from a fire hydrant or alternative water source is found. Because the pumper trucks have large water tanks, hose beds that store fire hoses are located high above the ground at the top of the pumper truck. High hose beds on top of the truck require a firefighter to climb a ladder or utilize other steps or holds that the firefighter must climb in order to reach the hose bed which may present difficulties in strength, agility and time when trying to store a fire hose properly for the next incident. At present, firefighters are not satisfied with the time and effort it takes to stow fire hose in hose beds and prepare a fire hose for future firefighting.

BRIEF SUMMARY OF THE INVENTION

Embodiments of the invention provide an ergonomic hose load platform, hose bed and fire fighting vehicle that permit a firefighter to rapidly store a fire hose from a hose bed located at the top of a fire fighting vehicle to the fire and thereby save lives and prevent property damage. These and other advantages of the invention, as well as additional inventive features, will be apparent from the description of the invention provided herein.

In one aspect, the invention provides an ergonomic hose load platform for a fire fighting vehicle. The ergonomic hose load platform includes a platform and an at least one pivot mount defining a pivot axis. The platform is pivotable about the pivot axis to open and close the platform.

The ergonomic hose load platform also includes an actuator to transition the platform from an open position to a closed position and from a closed position to an open position.

In an embodiment, in the open position the platform is configured to support at least the weight of a firefighter standing on the platform.

In another embodiment, in the closed position, the platform at least partially retains a fire hose in a fire hose bed of the fire fighting vehicle.

In yet another embodiment, the pivot axis of rotation extends substantially normal to forward and reverse directions of travel of the fire fighting vehicle.

In still another embodiment, the platform includes a hose clamp to clamp a fire hose to the platform, the clamp permitting a payout and a retrieval of the fire hose through the clamp.

In an embodiment, the platform includes a roller acting as a bearing surface for a fire hose.

In another embodiment, the platform includes a nonskid surface.

In yet another embodiment, the nonskid surface is applied adhesive to a top surface of the platform.

The ergonomic hose load platform of claim 7, wherein the nonskid surface is a diamond plate surface formed into a top surface of the platform.

In still another embodiment, the actuator, in the closed position of the platform, is in a retracted state and in the open position of the platform the actuator is in an extended state.

In still yet another embodiment, the platform includes a strut and in the closed position of the platform, the actuator is in an extended state and in the open position, the actuator is in a retracted state.

In another aspect, the invention provides a method for stowing a fire hose of a fire fighting vehicle. The method includes the step of pivoting a platform about a pivot axis to open a fire hose bed of the fire fighting vehicle. The method also includes the step of stowing the fire hose in the fire hose bed at least in part from the platform.

In an embodiment, the method includes the step of step of configuring the platform to act as an at least partial rear wall of the fire hose bed at the rear of the fire fighting vehicle.

In another embodiment, the step of opening the platform includes the step of actuating an actuator open the at least partial rear wall of the fire hose bed.

In another embodiment, the method includes the step of providing a firefighter on the platform in the open position of the platform to stow the fire hose.

In yet another aspect, the invention provides a fire fighting vehicle that includes an ergonomic hose load platform. The ergonomic hose load platform includes a platform that is foldable from a closed position to an open position and an at least one pivot mount defining a pivot axis. The platform is pivotable about the pivot axis. The ergonomic hose load platform also includes an actuator operable to transition the platform from an open position to a closed position and from a closed position to an open position. The fire fighting vehicle also includes a support structure to which the platform is mounted for rotation about the pivot axis between the dosed position and the open position. The fire fighting vehicle also includes a fire hose bed situated in the fire fighting vehicle. The fire hose bed includes a front wall, a bottom wall and a first and a second side wall extending from the bottom wall. The platform acts as an at least partial rear wall of the fire hose bed. In a closed position of the rear wall, the rear wall retains the fire hose in the fire hose bed.

In an embodiment, in rotation of the platform from the closed position to the open position the fire hose is connected to the platform.

In yet another embodiment, a strut connects the platform to an actuator and to the support structure. In the closed position of the platform the actuator is in an extended state and in the open position the actuator is in a retracted state.

In an embodiment, the actuator is a linear actuator.

In an embodiment, in the open position, a strut is located between a linear actuator and the platform.

In another embodiment, a controller actuates the actuator.

In yet another embodiment, the controller is located in the cab of the fire fighting vehicle.

In still another embodiment, the controller is located outside a cab of the fire fighting vehicle.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
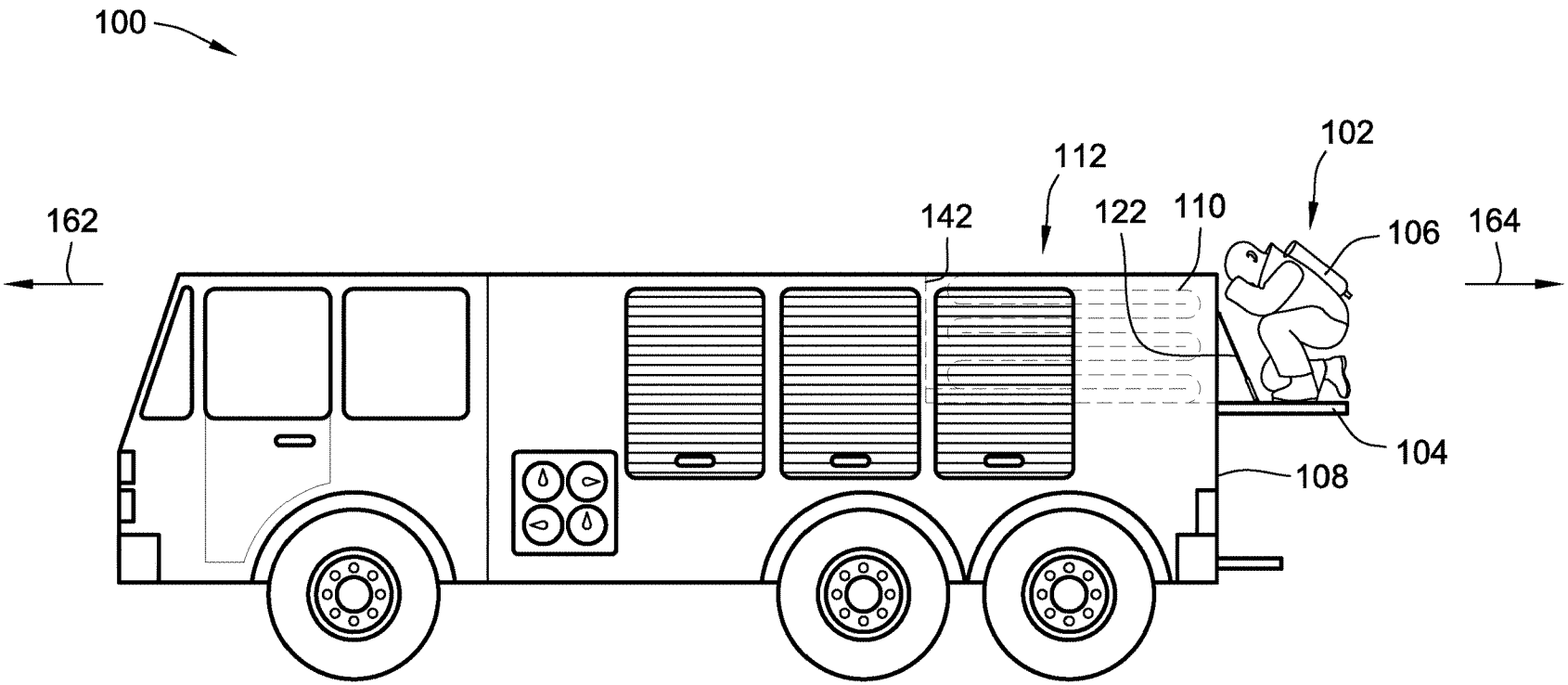
FIG. 1 is a schematic side view of an embodiment of a fire fighting vehicle having a fire hose bed including an ergonomic hose load platform according to the teachings of the present invention.

Turning now to the drawings, FIG. 1 illustrates fire fighting vehicle 100 including an embodiment of an ergonomic hose load platform 102 according to the teachings of the present invention. The ergonomic hose load platform 102 includes a platform 104 that is foldable from a closed position to an open position. The platform 104 may be interchangeably referred to herein as foldable platform 104. FIG. 1 illustrates the foldable platform 104 in the open position with a firefighter 106 kneeling on the foldable platform 104. The foldable platform 104 is mounted to a support structure 108. The support structure may be the rear bulkhead 108 of the fire fighting vehicle 100 and in other embodiments may be one or both the sides of the fire fighting vehicle 100 or both the rear bulkhead 108 and one or more of the sides of the fire fighting vehicle by way of non-limiting examples. The foldable platform 104 is mounted for rotation about a pivot axis 138 (FIG. 2) between the closed position and the open position.

By providing a foldable platform 104 at the rear of the fire fighting vehicle 100 firefighters gain rapid access to a fire hose 110 located in a fire hose bed 112 situated on top of the fire fighting vehicle 100. That is, rather than having to climb the rear wall 108 of the fire fighting vehicle 100 to gain access to the hose bed 112, the fire hose 110 is connected directly to the foldable platform 104 and can be immediately accessed by the firefighter as soon as the foldable platform 104 is opened. The firefighter may also stand on the platform, as needed to reach the fire hose 110 in the hose bed 112 to either easily deploy the fire hose 110 or to retrieve and stow, that is store the fire hose 110 at the end of fire fighting operations. This ease of access to a fire hose bed 112 situated on top of a fire fighting vehicle 100, heretofore unknown in fire fighting vehicles, greatly decreases the time needed to stow a fire hose 110 for rapid deployment at a next firefighting incident. Indeed, stowage is often slow because a firefighter has difficulty balancing himself on the fire truck while at the same time pulling a fire hose 110 up into the hose bed 112 while another firefighter may be in the hose bed 112 to properly stow the fire hose 110 in careful folds for the next incident. Therefore, the provision of an ergonomic hose platform 102 advantageously assists fire fighters in their efforts to rapidly stow a fire hose 110 for the next incident and save lives and property thereby. These and other advantages of the present invention will be further discussed herein.

The fire fighting vehicle 100 includes the fire hose bed 112 that includes a front wall 142, a bottom wall 144 (FIG. 2), first 146 and a second 148 sidewalls (FIG. 2) extending from the bottom wall 144 towards a top of the fire fighting vehicle 100. The foldable platform 104 in the closed position advantageously acts as an at least partial a rear wall (FIG. 4) of the hose bed 112 to retain a fire hose 110 in the fire hose bed 112. In other words, because the foldable wall 104 acts as a rear wall that extends at least partially above the bottom wall 144, then the fire hose 110 is not free to slide rearwards out of hose bed 112.

Figure 2:
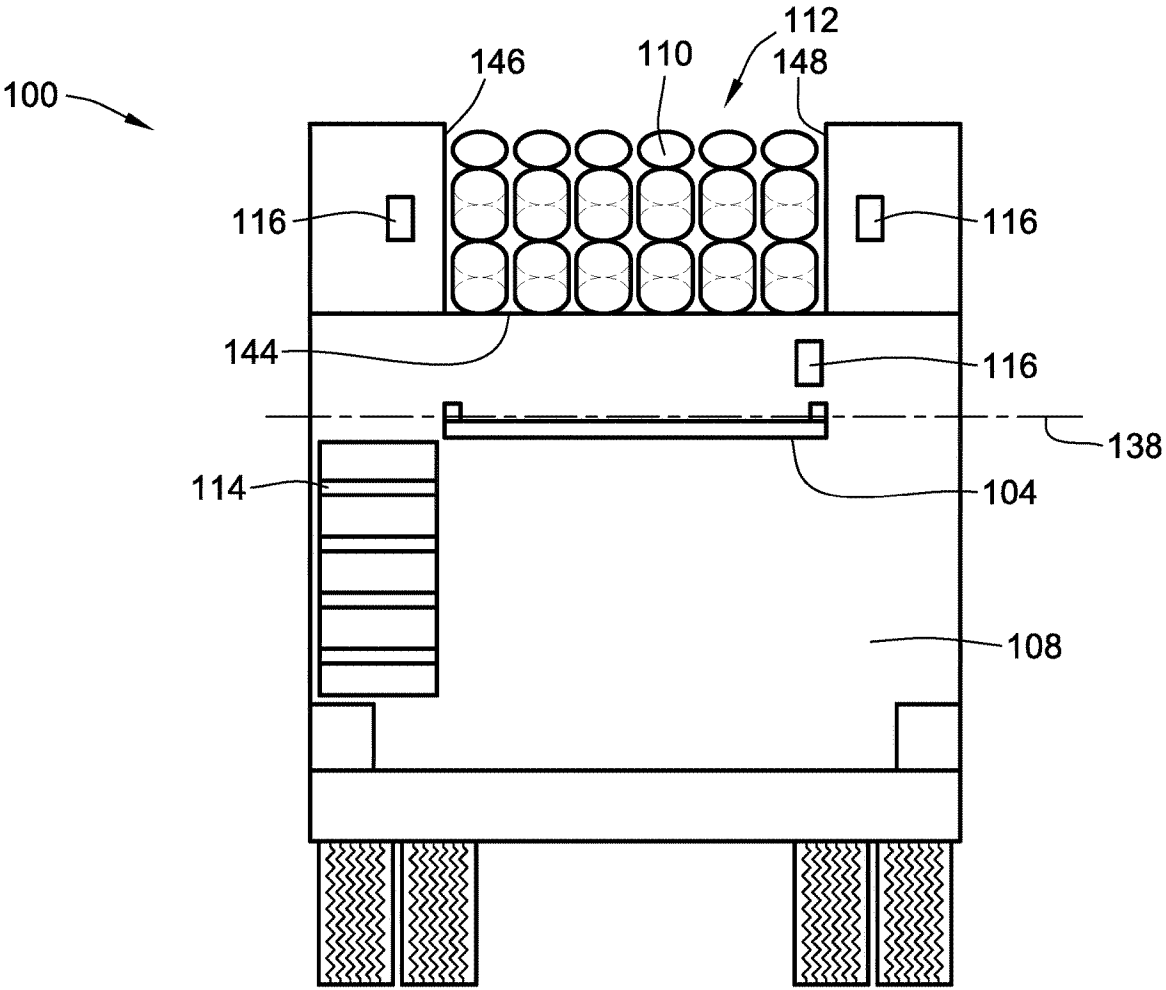
FIG. 2 is a schematic rearview of the fire fighting vehicle of FIG. 1.

Turning now to FIG. 2, a schematic rear view of the fire fighting vehicle 100 of FIG. 1 is illustrated. Advantageously, the foldable platform 104 in the open position allows the firefighter 106 to easily access the hose bed 112 located on the top of the fire fighting vehicle 100. In some cases the fire fighting vehicle 100 may require use of a ladder 114 or other steps and/or handholds (not shown) to facilitate the firefighter's 106 climb in order to be able to stand on the mobile platform 104. This allows the firefighter 106 advantageous access to the hose bed 112 to either deploy the fire hose 110 when needed or to stow a fire hose 110 for rapid deployment at a next firefighting incident. While a ladder 114 is illustrated here, it may not always be the case that foldable platform 104 is so high that it cannot be accessed by other means; for example, stepping on a rear bumper. Accordingly, it is not the intent in providing such examples to either limit the height above ground of the foldable platform 104 on the support structure 108 or the means of access to reach the foldable platform 104.

Figure 6:
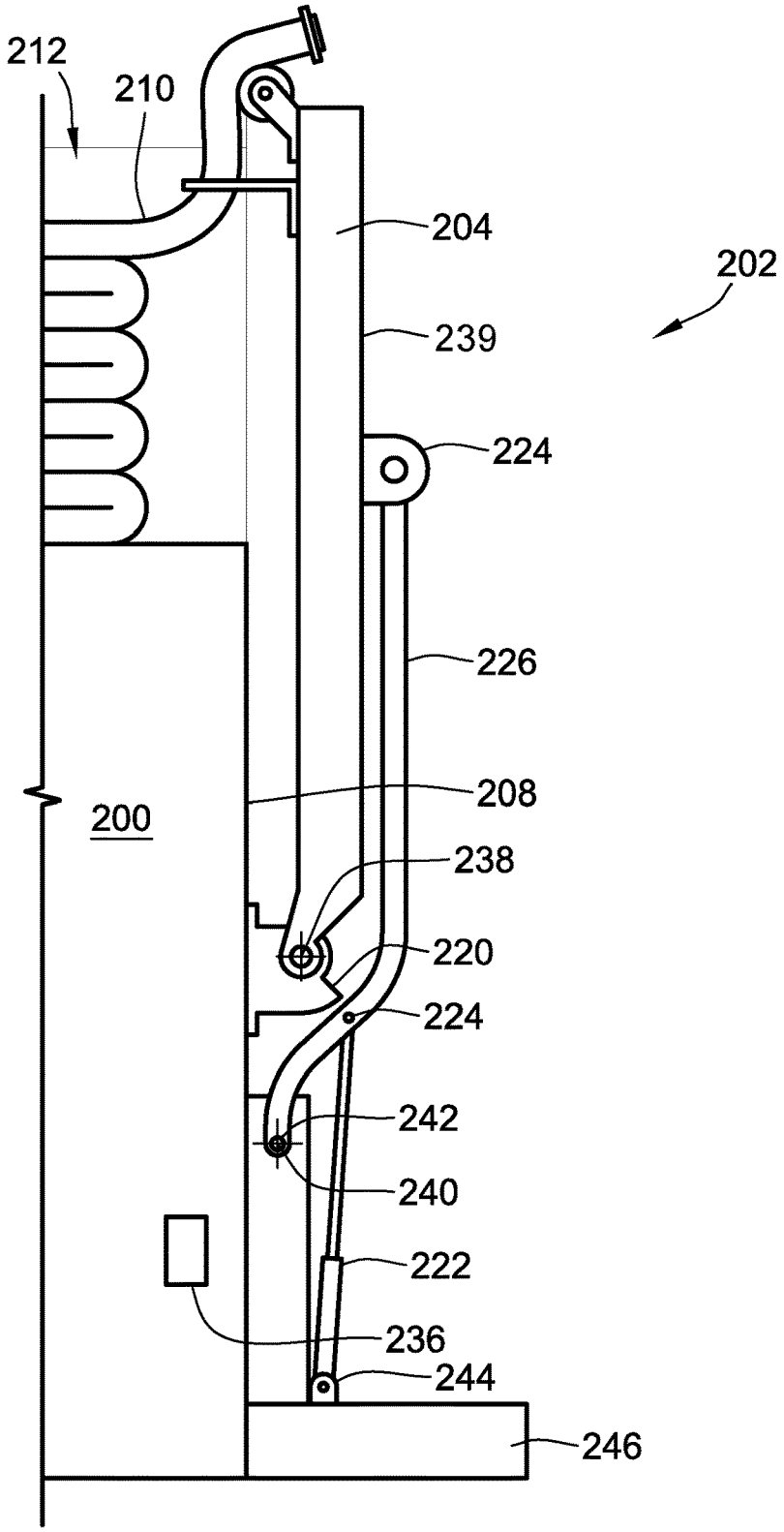
FIG. 6 is a schematic side view of an embodiment of an ergonomic hose load platform in the closed position and utilizing a strut and an actuator.

Foldable platform 104 may also include a nonskid surface 118 (FIG. 6) on which the firefighter 106 may stand to facilitate traction in handling the fire hose 110, which may be of particular benefit in wet conditions. The nonskid surface may be formed into a top surface of the foldable platform 104 as a diamond plated surface (not illustrated) or the nonskid surface may be an applied layer of adhesive as illustrated in FIG. 6. Further, anchor mounts 116 may be present along the rear bulkhead 108 of the fire fighting vehicle 100 or along sidewalls 146 and 148 to allow the firefighter 106 to safely be harnessed and tethered to the anchor mounts 116 to prevent unwanted falls from the foldable platform 104. It will be understood that the illustrations are not intended to limit the configuration of location or type of the anchor mounts 116.

The foldable platform 104, in the open position, is mounted to the support structure 108, in this case, the rear bulkhead 108 of the fire fighting vehicle 100, utilizing means discussed in greater detail below such that the foldable platform 104 is fully able to support the weight of a firefighter 106 standing and working on the foldable platform 104. Further, it should be noted that the foldable platform's 104 rotation axis 138 is substantially normal to a forward 162 and reverse 164 direction of travel (FIG. 1) of the fire fighting vehicle 100.

Figure 3:
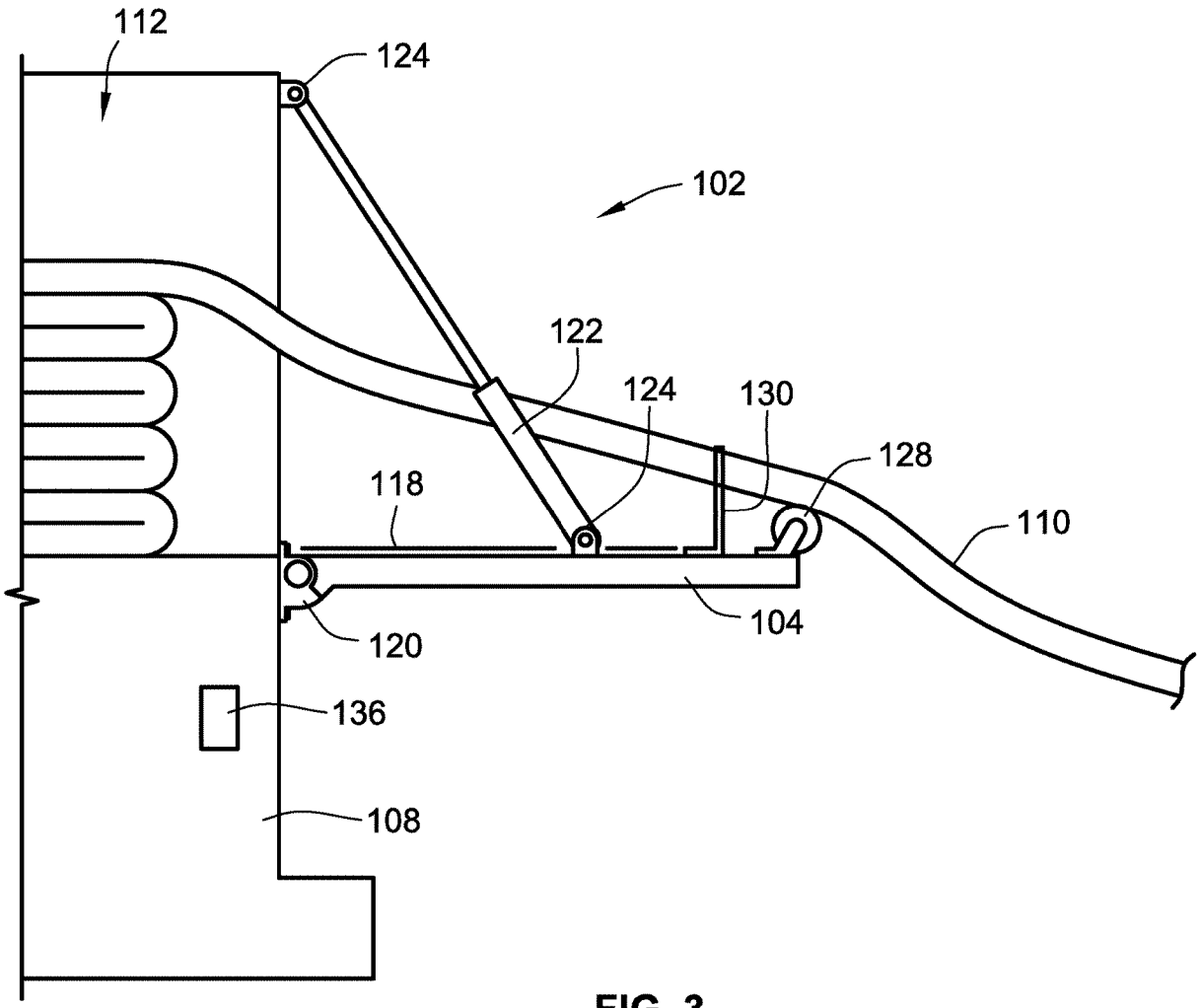
FIG. 3 is an exaggerated partial schematic side view of an embodiment of an ergonomic hose load platform utilizing an actuator.

Turning now to FIG. 3, an exaggerated schematic side view of an embodiment of an ergonomic hose load platform 102 according to the teachings of the present invention is illustrated. Here, the foldable platform 104 is shown in the open position with fire hose 110 deployed from hose bed 112. An actuator 122 connects the support structure 108 to the foldable platform 104 to open and close the foldable platform about the rotation axis 138. Although a linear actuator is illustrated here, it should be readily understood that other actuating systems may be utilized provide they permit the opening and closing of the foldable platform 104, for example direct drive motors or indirect drive motors etc.

The actuator 122 may be connected at a first end to the support structure 108 by a pinned joint 124. The pinned joint 124, as may be readily appreciated by those skilled in the art, may be any number of fastening means including bolts or screws by way of non-limiting examples. It is not the intent to limit the location or types of pinned joints by way of the foregoing non-limiting examples. Indeed, the actuator 122 may be connected to the rear bulkhead 108 of the fire fighting vehicle 100 or may be connected to a sidewall or top thereof. A second end of the actuator 122 connects via a pinned joint 124 the actuator 122 to the folded platform 104. Its point of attachment, or means of attachment, may be at any point or type of fastening arrangement so long as the foldable platform 104 may still open and close to act as a rear wall of the fire hose bed 112. It may now be readily appreciated that the platform 104 is configured to support the weight of a firefighter because of the strength of the materials of the foldable platform 104 itself, for example, steel in cooperation with the strength of the actuator 122 sized to support the weight of the firefighter and the strengthen of the connection means to the fire fighting vehicle, for example pivot mounts 120.

The actuator 122 in FIG. 3 is shown in an extended state. When the actuator 122 is in the extended state, the foldable platform 104 is in the open position. When the actuator 122 is in a retracted state (FIG. 4), the foldable platform 104 is in the closed stated and acts as an at least partial rear wall of the fire hose bed 112 to retain the fire hose 110. The foldable platform 104 also includes at least one pivot mount 120 that cooperates with a pivot stop 132 to limit the pivoting motion of the foldable platform 104 about a pivot axis 138 from the closed position to the open position. The pivot axis 138 is defined by the pivot mount 120. Pivot mount 120 and pivot stop 132 provide the means of connection to the fire fighting vehicle 100. Although a pivot mount is illustrated, it is not the intent to limit the pivoting means. It can be appreciated the type and location of the pivot mount may be any that provide for the open and closing of the foldable platform 104. The foldable platform 104 may also include a roller 128 that advantageously allows the fire hose 110 to be paid out or pulled (when stowing the fire hose 110) with minimal friction, as compared for example with simply paying out our pulling the fire hose 110 in directly over the nonskid surface 118.

In an embodiment, the ergonomic hose load platform 102 may have a single actuator 122. In a more preferred embodiment, the ergonomic hose load platform 102 may have two actuators 122. The actuator 122 may be operated manually or may include an electronic controller 136 to extend and retract the linear actuator 122 to rotate the foldable platform 104 about rotation axis 138 to the closed position and open position and from the open position to the closed position. The electronic controller 136 may be located proximate to foldable platform 102 on the rear bulkhead 108 or on a side of the fire fighting vehicle 100 or in the cab of the fire fighting vehicle 100 or both in the cab of the fire fighting vehicle 100 and on the exterior of the fire fighting vehicle. It is not the intent to limit the location of the electronic controller 136 by these non-limiting examples.

Figure 4:
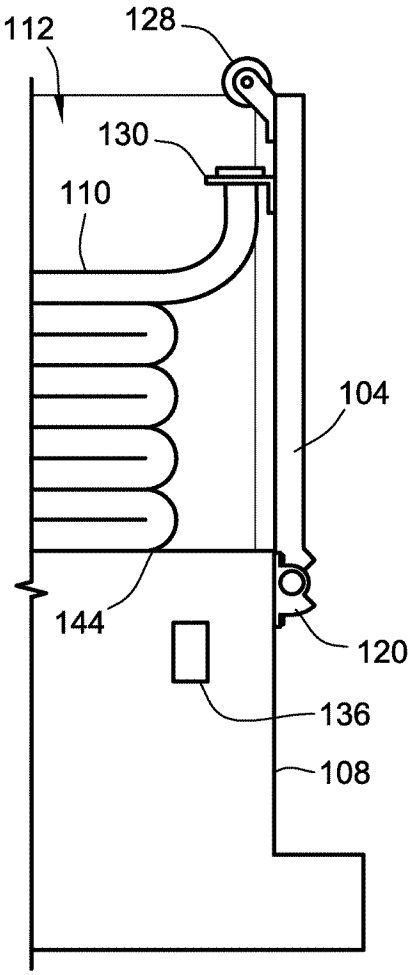
FIG. 4 is an exaggerated schematic of an embodiment of an ergonomic hose load platform in the closed position.

Turning now to FIG. 4, the foldable platform 104 is illustrated in an exaggerated schematic side view that shows the foldable platform in in the closed position. The figure illustrates that in the closed position of the foldable platform 104, and in rotation from the closed position to the open position, the fire hose 110 connects to the foldable platform 104. The connection, by way of a non-limiting example, may be by a fire hose clamp 130 that connects a top surface 140 of the foldable platform 104 to the fire hose 110. The connection advantageously allows a firefighter 106 to actuate the actuator 122 to rotate the foldable platform 104 from the closed position to the open position such that in the open position, while the firefighter remains standing on the ground he may easily reach the fire hose 110, connected to the open platform 104 to rapidly payout the fire hose 110 from the hose bed 112.

The roller 128 may be incorporated into the hose clamp 130. It can be readily appreciated that the roller 128 and hose clamp 130 cooperate to retain the fire hose 110 to the foldable platform 104 while at the same time allowing for the fire hose 110 to slide through the clamp 130 and along the roller 128 to facilitate payout and retrieval of the fire hose 110. It can also be readily appreciated that there may be times where the clamp 130 might not be used or times when only the roller 128 is utilized or avoided all together.

Connection of the fire hose 110 to the foldable platform 104 via hose clamp 130 advantageously avoids the undesirable delay required when a firefighter must climb a ladder on the rear bulkhead 108 of the fire fighting vehicle 100, or a sidewall of the fire fighting vehicle 100 so as to reach the hose bed 112 located at the top of the fire fighting vehicle 100. Such high hose beds 112 make it very difficult for the firefighter 106 to access the hose bed 112 and the fire hose 110 therein from the ground and thus delaying payout or rapid stowing of the fire hose 110. Accordingly, the foldable platform 104 with the hose clamp 130, or other means known in the art, to connect the fire hose 110 to the foldable platform 104 advantageously allows the firefighter to reach the fire hose 110 once the foldable platform 104 is opened.

Advantageously the foldable platform 104 acts as an at least partial rear wall of the hose bed 112. The foldable platform 104, in the closed position, at least partially retains a fire hose 110 and the hose bed 112 of the fire fighting vehicle 100. Hose load platform 102 advantageously allows for the rapid deployment of the fire hose 110 because of its hose clamp 130 connecting it to the full platform 104 and advantageously allows a firefighter 106 to stand on the platform to work and access the hose bed 112. By standing on the foldable platform 104 the firefighter may easily reach the hose bed 112 to arrange and stow the fire hose 110 after a fire.

Figure 5:
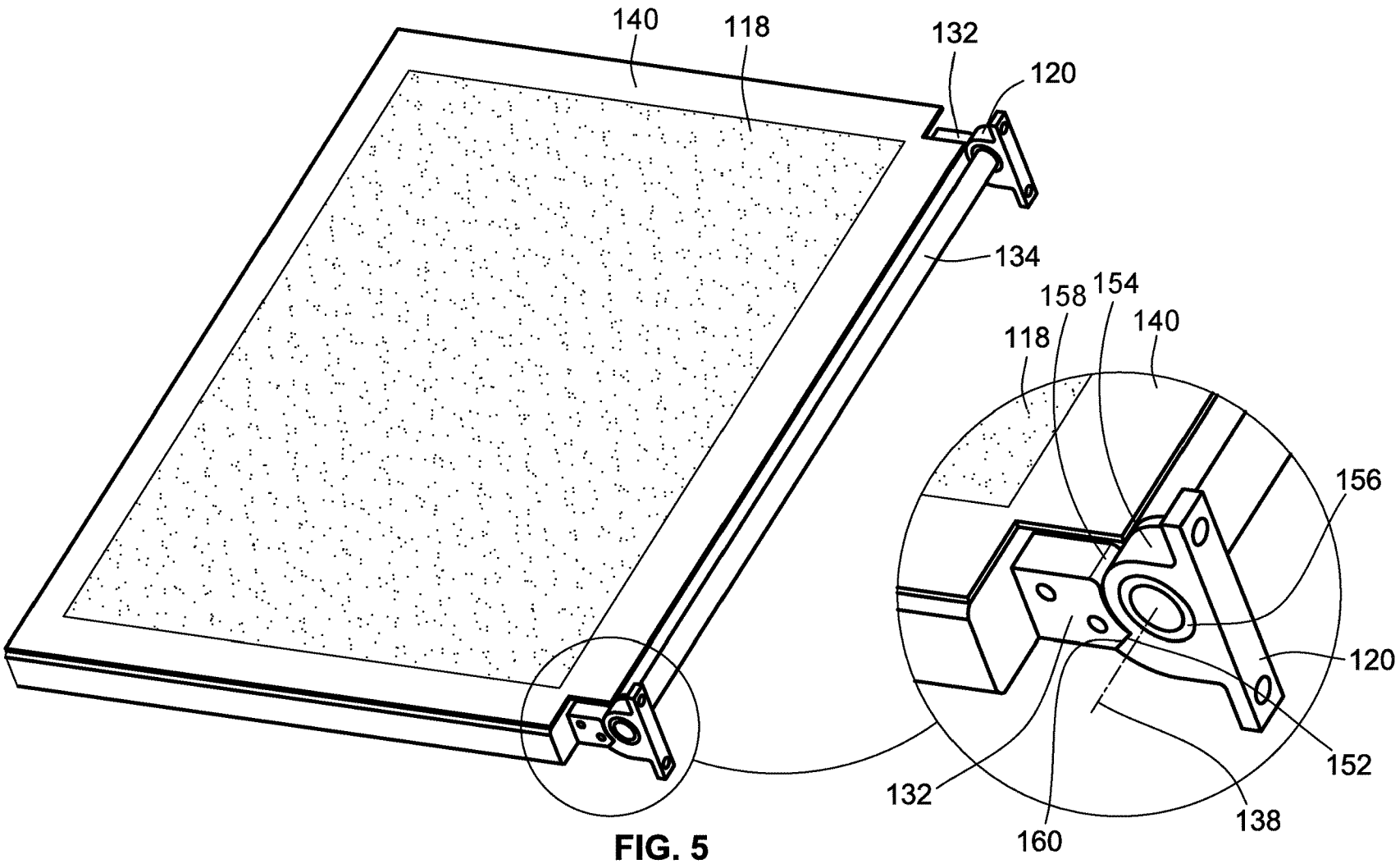
FIG. 5 is a perspective view of an embodiment of a foldable platform of an ergonomic hose load platform.

FIG. 5 illustrates a perspective view of an embodiment of the foldable platform 104. The foldable platform 104 has a top surface 140 covered, at least partially by a layer of nonskid material 118. Pivot stops 132 mount to opposing sides of foldable platform 104 to cooperate with pivot mounts 120. Pivot mounts 120 mount to support structure 108 which may be the rear bulk head of the fire fighting vehicle 100. Pivot stops 132 and pivot mounts 120 cooperate to facilitate rotation of the foldable platform 104 between the closed and open positions. While the pivot mounts 120 and pivot stops 132 are disclosed and illustrated in detail herein, it is not the intent to limit the connection means or location thereof between the foldable platform 104 and support structure 108 as other connection means may be possible, provided they allow for rotation to and from the open and closed position of the foldable platform 104. As previously discussed, it should be noted again that other structures may be utilized for limiting the travel of platform 104.

Pivot mount 120 includes a removable press-fit bearing 156 to facilitate insertion of the shaft 134 to facilitate rotation about axis 138. The pivot mount 120 also includes a cylindrical bearing surface 154 and a pivot mount receiving face 152. Pivot stop 132 includes a bearing face 158 that mates with and cooperates with cylindrical bearing surface 154 to allow for rotation of the foldable platform 104 between the closed position and the open position about the axis of rotation 138. In the open position, pivot stop face 160 mates with, and therefore cooperates with, pivot mount receiving face 152 to limit the pivoting motion of the foldable platform 104 about the axis 138 from the closed position to the open position.

Figure 7:
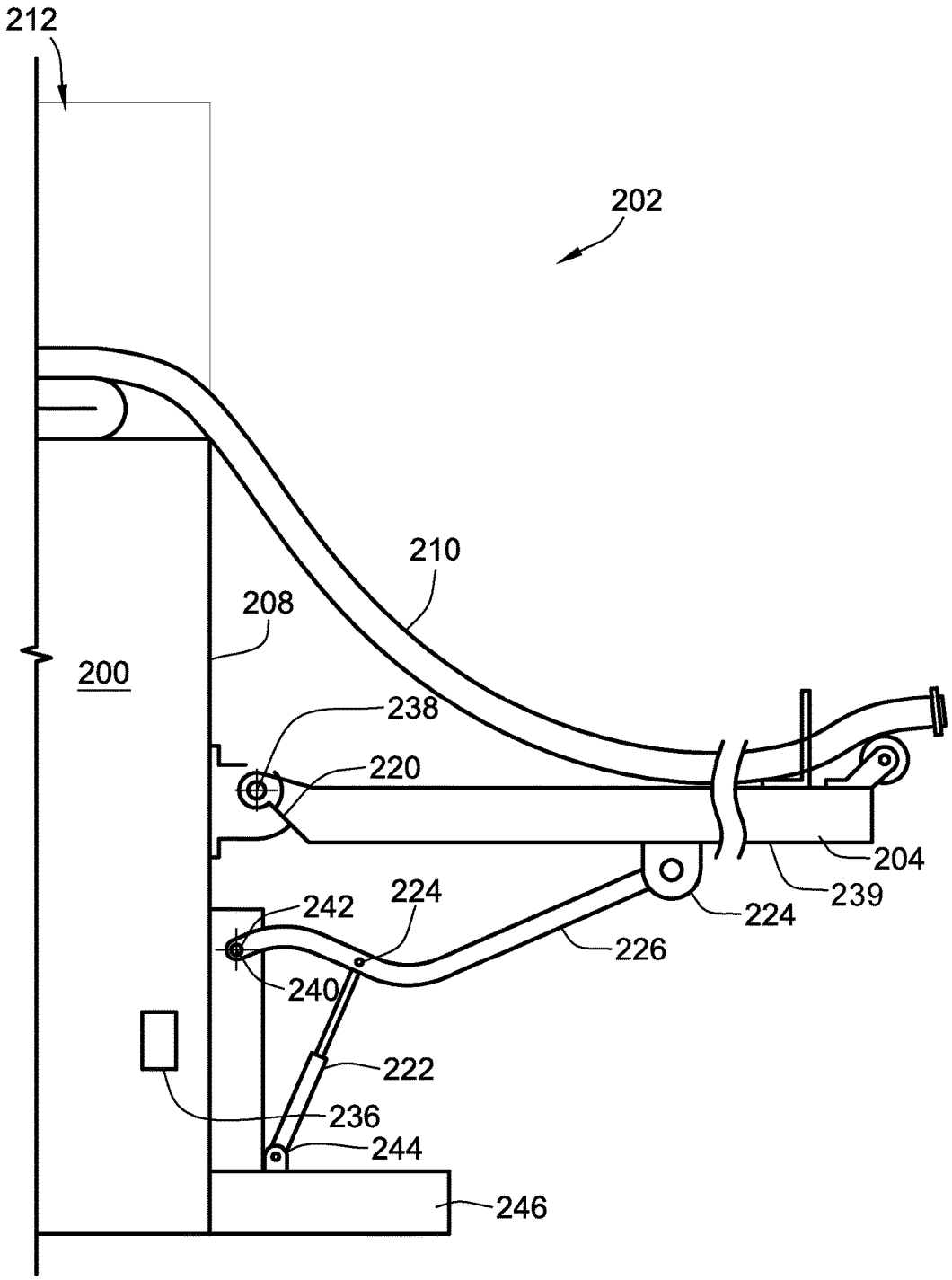
FIG. 7 is a schematic side view of an embodiment of the ergonomic hose load platform of FIG. 6 in the open position.

FIG. 6 and FIG. 7 illustrate another embodiment of an ergonomic hose load platform 202. FIG. 6 illustrates the embodiment of the ergonomic hose load platform 202 in its closed state, while FIG. 7 illustrates the ergonomic hose load platform 202 in its open state.

Ergonomic hose load platform 202 has all the advantages discussed with respect to ergonomic hose load platform 102 including rapid storage and deployment of fire hose 210 from hose bed 212. However, it differs from 102 because it utilizes at least one strut 226 connected to at least one actuator 222 to open and close a foldable platform 204. More than one strut 226 and more than one actuator 222 may be utilized and the locations thereof and means of connection to the fire truck may be by any known fasteners or even welds provide the foldable platform may be rotated open and closed.

The foldable platform 204 is connected to the at least one strut 226 at a first end of the strut pinned joint 224 that may be located on a bottom surface 239 of the foldable platform 204. More than one strut 226 may be utilized and attached to the foldable platform 204 by fastening means such as the pinned joint 224 or other fastening means known in the art such that the foldable platform 204 is allowed to rotate about axis 238 between the closed and open position and between the open and close position. The struts 226 may be located, for example on opposite sides of the foldable platform 204 and may connect to the foldable platform 204 at various locations such as opposed sides of the foldable platform 204.

The actuator 222 has a first end to connect to the strut 226 at fastening joint 224 located between the first and second ends of the strut 226 while a second end of the linear actuator 222 may be connected to the support structure 208 of the fire fighting vehicle 200 at fastener joint 244. As may now be readily appreciated, the second end of the linear actuator 222 may connect at a sidewall of the fire fighting vehicle 200 or even on a bumper 246 of the vehicle. It is not the intent by way of these non-limiting examples to limit the points of connection or means of connection. Further, more than one actuator 222 may be utilized.

While the first end of the strut 226 is connected to the bottom surface 239 of the foldable platform 204, the second end is connected to the rear bulkhead 208 or sidewall of the fire fighting vehicle 200, for example, with means such as a pivot mount 220 and pivot stop to facilitate rotation of the strut about a rotation axis 240 at the second end of the strut 226 so that the foldable platform 204 may rotate about its axis 238 to open and close the foldable platform 204.

Moreover, as illustrated, the strut 226 is curved proximate the second end such that the actuator 222 may be a linear actuator and wherein actuation of the linear actuator 222 rotates the strut 226 about rotation axis 240 to move the foldable platform 204 from the closed position to the open position and from the open position to the closed position. Accordingly, in the closed position (FIG. 6) of the foldable platform 204, the actuator 222, located below the foldable platform 204, is in an extended state; and in the open position of the foldable platform 204, the actuator 222 is in a retracted state (FIG. 7). As with the other embodiments, the actuator 222 may be manually actuated or controller 236 may be provided for electrical actuation.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for stowing a fire hose of a fire fighting vehicle, the method comprising the steps of:

pivoting a platform about a pivot axis to open a fire hose bed of the fire fighting vehicle;

paying out the fire hose from the hose bed through an opening of a hose clamp mounted to the platform; and supporting the fire hose via at least one roller after the fire hose has passed through the opening, wherein the roller extends beyond a peripheral edge of the platform.

2. The method of claim 1, including the step of configuring the platform to act as an at least partial rear wall of the fire hose bed at the rear of the fire fighting vehicle.

3. The method of claim 2, wherein the step of opening the platform includes the step of actuating an actuator to open the at least partial rear wall of the fire hose bed.

4. The method of claim 1, further comprising a step of stowing the fire hose in the fire hose bed at least in part from the platform, wherein the step of stowing is configured to be performed by a firefighter on the platform.

5. A fire fighting vehicle comprising:

a fire hose bed defined by a front wall, a pair of opposed side walls, a bottom wall, and a rear wall, the fire hose bed bounding a space for the containment of a fire hose;

wherein the rear wall is formed by a foldable platform, the platform mounted to a support structure of the fire fighting vehicle by at least one pivot mount, the pivot mount defining a rotational axis about which the platform rotates between an open position and a closed position and between the closed position and the open position, the platform further comprising a pivot stop;

wherein the pivot mount defines a pivot mount receiving face and the pivot stop defines a pivot stop face, the pivot mounting receiving face and the pivot stop face arranged such that they abut one another to define a maximum rotational position of the platform; and wherein the platform further comprises a hose clamp defining an opening through which the fire hose is routable, and a roller aligned with the opening such that the roller supports the fire hose after it passes through the opening.

6. The fire fighting vehicle of claim 5, further comprising an actuator, wherein the actuator transitions the platform from the open position to the dosed position and from the closed position to the open position.

7. The fire fighting vehicle of claim 6, wherein the actuator is a linear actuator.

8. The fire fighting vehicle of claim 7, wherein in the open position, a strut is located between the linear actuator and the platform.

9. The fire fighting vehicle of claim 6, further comprising a controller to actuate the actuator.

10. The fire fighting vehicle of claim 9, wherein the controller is located in a cab of the fire fighting vehicle.

11. The fire fighting vehicle of claim 9, wherein the controller is located outside a cab of the fire fighting vehicle.

* * * * *